US008215376B2

(12) United States Patent
Scott et al.

(10) Patent No.: US 8,215,376 B2
(45) Date of Patent: Jul. 10, 2012

(54) CONTINUOUS CAST MOLTEN METAL MOLD AND CASTING SYSTEM

(75) Inventors: Timothy A. Scott, Hauser, ID (US); Brett A. Thielman, Spokane, WA (US); Gary P. Grealy, Liberty Lake, WA (US)

(73) Assignee: Wagstaff, Inc., Spokane, WA (US)

( * ) Notice: Subject to any disclaimer, the term of this patent is extended or adjusted under 35 U.S.C. 154(b) by 509 days.

(21) Appl. No.: 12/202,372

(22) Filed: Sep. 1, 2008

(65) Prior Publication Data

US 2010/0051225 A1 Mar. 4, 2010

(51) Int. Cl.
*B22D 11/049* (2006.01)

(52) U.S. Cl. ..... 164/444; 164/487

(58) Field of Classification Search ..... 164/487, 164/444

See application file for complete search history.

(56) References Cited

U.S. PATENT DOCUMENTS

| | | | | |
|---|---|---|---|---|
| 3,375,863 | A | | 4/1968 | Atkin et al. |
| 4,069,862 | A | * | 1/1978 | Carson ..... 164/439 |
| 4,598,763 | A | | 7/1986 | Wagstaff et al. |
| 4,709,744 | A | | 12/1987 | Bryson et al. |
| 5,518,063 | A | | 5/1996 | Wagstaff et al. |
| 5,873,405 | A | | 2/1999 | Carrier et al. |
| 6,609,557 | B1 | | 8/2003 | Anderson |

* cited by examiner

*Primary Examiner* — Kuang Lin
(74) *Attorney, Agent, or Firm* — Wells St. John PS

(57) ABSTRACT

A continuous cast molten metal mold and casting system is disclosed, which may include a heat distribution or temperature management system for billet type molds, a mold assembly expansion system for continuous cast molds and/or an adjustable mold bore length mechanism.

8 Claims, 12 Drawing Sheets

CONTINUOUS CAST MOLTEN METAL MOLD AND CASTING SYSTEM

CROSS REFERENCE TO RELATED APPLICATION

This application does not claim priority from any other application.

TECHNICAL FIELD

This invention pertains to continuous cast molten metal mold and casting systems including a heat distribution or temperature management system or billet type molds, an expansion system for continuous cast molds and an adjustable mold bore length system.

BACKGROUND OF THE INVENTION

Metal ingots, billets and other castparts may be formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation, aluminum, brass, lead, zinc, magnesium, copper, steel, etc., the examples given and preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a bottom block 108 (also referred to as a starting head or starting block base), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart 113 (which may be an ingot or a billet being partially formed. Castpart 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block is typically used when an ingot is being cast and starting head when a billet is being cast.

While the starting block base 108 in FIG. 1 only shows one starting block 108 and pedestal, there are typically several of each mounted on each starting block base, which simultaneously cast billets, special tapers or configurations, or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a pre-determined rate, thereby lowering the ram 106 and consequently the starting block at a pre-determined and controlled rate. The mold is controllably cooled during the process to assist in the solidification of the emerging ingots or billets, typically using water cooling means. Although the use of a hydraulic cylinder is referred to herein, it will be appreciated by those of ordinary skill in the art that there are other mechanisms and ways which may be utilized to lower the platen.

There are numerous mold and casting technologies that fit into mold tables, and no one in particular is required to practice the various embodiments of this invention, since they are known by those of ordinary skill in the art.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired profile, taper or other desired configuration. In some casting technologies, there may be an air gap between the emerging solidified metal and the permeable ring wall, while in others there may be direct contact. Below that, there is also a mold air cavity between the emerging solidified metal and the lower portion of the mold and related equipment.

Once casting is complete, the castparts, billets in this example, are removed from the bottom block.

In this process, it is generally desired to seek a more uniform temperature distribution of the molten metal delivered to the mold from the molten metal distribution system. It is an object of some embodiments of this invention to provide an improved mechanism, way and/or means to deliver molten metal from the molten metal distribution system to the mold cavity.

It is also desired in molten metal casting processes and an object of some embodiments of this invention, such as in large diameter billet molds, to achieve an improved way of centering the transition ring. It is further desired and an object of this invention to provide such a way of centering the transition ring that remains centered during the expansion and contraction that occurs from the introduction and removal of the substantial amount of heat that occurs as a result of the casting process.

It is further desired in molten metal casting to move toward the optimization of what is referred to as the "bore length" of the mold assembly, and it is a further object of some embodiments of this invention to provide a bore length variation system for a mold assembly which allows for the relatively simple changing of the bore length of a mold.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 12 is an elevation view of one example of a trough assembly vertically over a mold assembly which may be utilized in embodiments of this invention.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
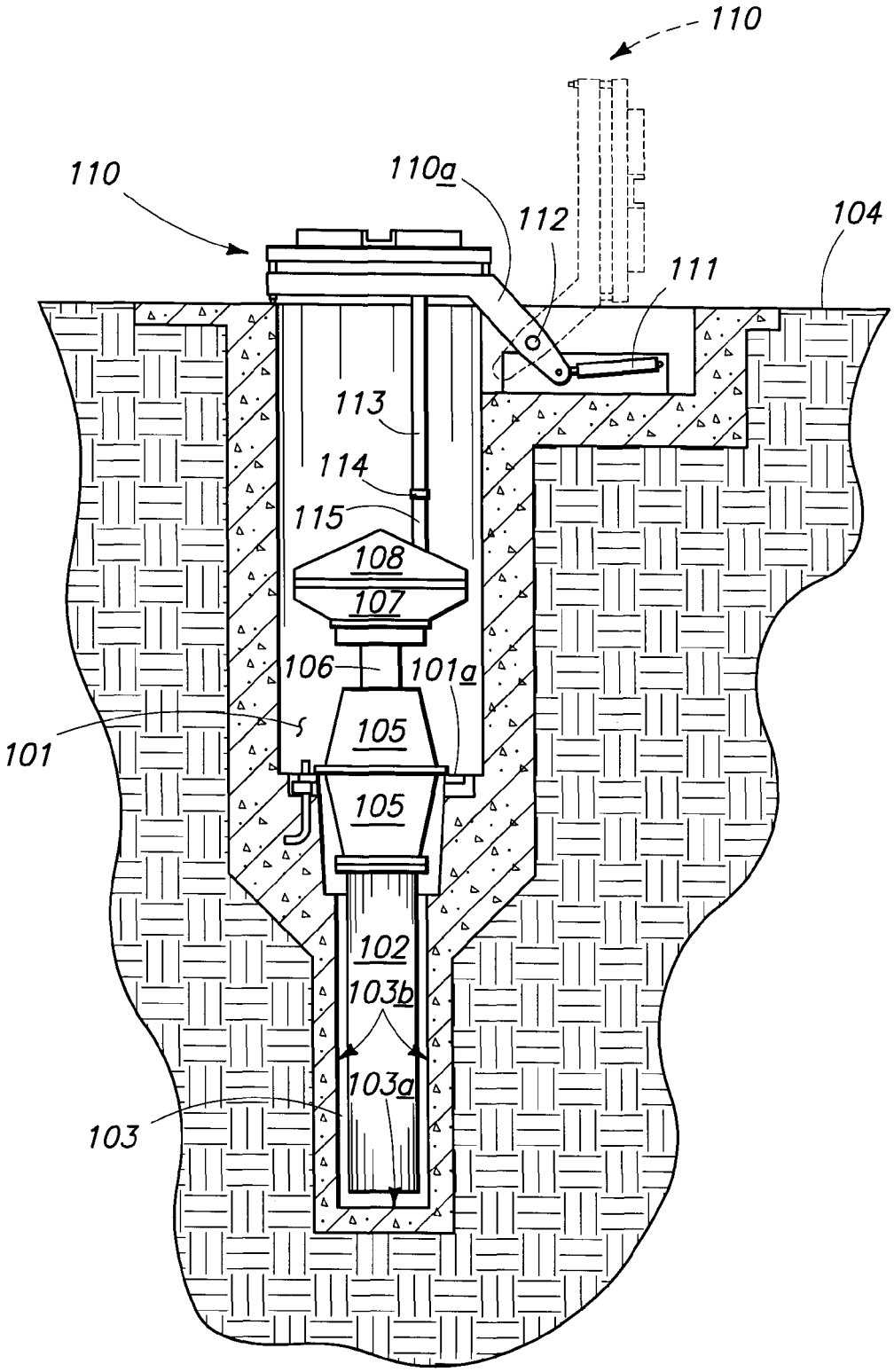
FIG. 1 is an elevation view of a prior art vertical casting pit, caisson and metal casting apparatus.
Figure 2:
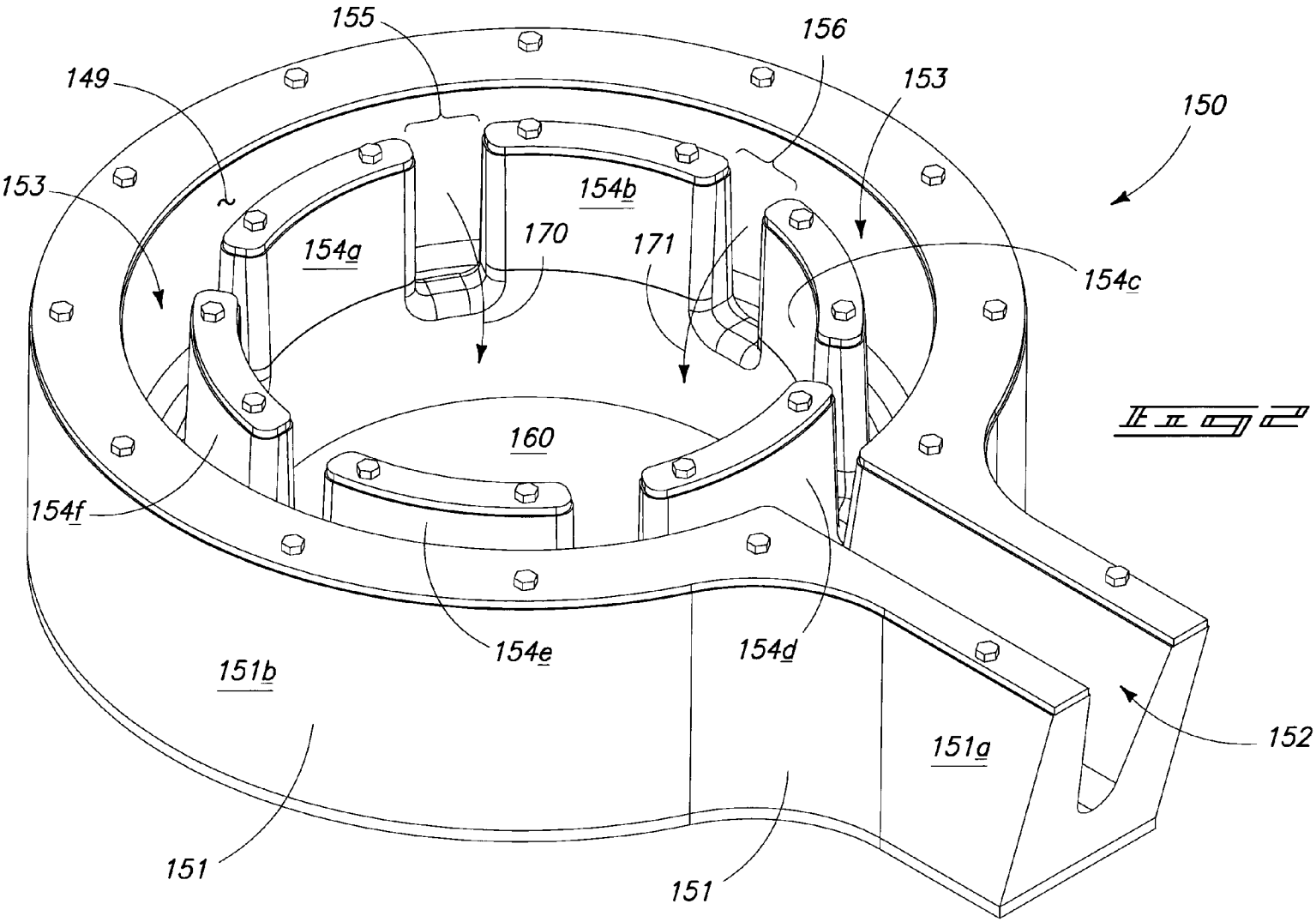
FIG. 2 is a perspective view of one example of a trough assembly which may be utilized in embodiments of this invention.

FIG. 2 is a perspective view of one example of a trough assembly which may be utilized in embodiments of this invention. FIG. 2 illustrates molten metal trough system 150, trough body 151 with molten metal entrance portion 151*a*, main body portion 151*b*, trough aperture 160 through which molten metal flows to a mold assembly, molten metal internal trough 153 and molten metal apertures or gates 155 and 156 in internal wall portions 154 and through which molten metal will flow from internal trough 153 through gates 155, 156 and others, and through trough aperture 160 to the mold assembly. The outer trough wall 149 (or outer trough containment wall) provides the containment of the molten metal on the outer side with the inner trough wall 154 or barrier provide the containment and flow control features on the inner side of the inner trough. Metal flow through gates 155 and 156 is represented by arrows 170 and 171 respectively. While only two molten metal gates or apertures 155 and 156 are identified by number, others are shown and the specific number of gates or apertures utilized in any specific trough assembly system may be adjusted based upon the application with no one particular number of gates or apertures, or size and configuration of gates being required to practice this invention. The lips or lower end of the gate areas may also be varied for the desired molten metal flow characteristics, or there may be a variation of the gate lip heights to affect the molten metal flow in a given application, all within the contemplation of this invention.

Molten metal is introduced into the trough assembly 150 through inlet trough 152 and then flows around internal trough 153 and eventually through the gates or apertures (items 155 and 156 for example) and into the trough aperture 160. This describes the process during start-up. During start-up the molten metal is initially delivered to a bottom block positioned in the mold cavity and the molten metal level rises, and eventually steady state conditions will be reached. During steady state flow conditions, the molten metal level will generally remain above the bottom portion of the molten metal gates and there will be a continuous flow of metal from trough inlet 152 into internal trough 153 and through the gates with the metal level being part of the way up the gates. In one example the molten metal level may be maintained at approximately the middle portion of the gates or apertures.

FIG. 2 further illustrates the internal wall portions 154*a*, 154*b*, 154*c*, 154*d*, 154*e* and 154*f* which provide the interior barrier for the internal trough 153 and also defines the respective molten metal gates or apertures.

It will be appreciated by those of ordinary skill in the art that this invention would include different configurations, sizes and locations of molten metal gates within the internal wall 154 (a combination of internal wall portions 154*a*, 154*b*, 154*c*, 154*d*, 154*e* and 154*f*) of the trough assembly 150. It may be desirable in some embodiments of the invention to make the gates different heights relative to internal trough 153. It may also be desirable in some embodiments of the invention to change the gate widths or other parameters to adjust the flow characteristics and in turn adjust the desired temperature distribution of the molten metal as it is delivered through the trough aperture 160 and into the mold. In some embodiments, it will be desired to for instance to configure the gates non-symmetrical in that there are more gates at one side or area of the trough than another (such as more gate area on the side of the trough opposite the trough inlet 152), or those gates may be positioned higher or lower, or to provide for more flow per gate by changing the dimensions (height of the lip, width or other gate area related parameters), all within the contemplation of this invention.

It will be desirable in some applications or embodiments of this invention to appropriately size the internal channel 153 relative to the gates to achieve more even flow through the gates. In some embodiments of the invention achieving a more even flow around the periphery of the trough system will tend to achieve better temperature distribution and heat management in the mold area where the molten metal is delivered. In some embodiments of the invention achieving a higher velocity of the flow of the molten metal through the gates may be desirable and achieve more optimum heat or temperature distribution in the molten metal as delivered to the mold assembly area, all within the contemplation of aspects of this invention. It is generally desirable in molding to achieve a more uniform distribution of heat and temperature of the molten metal as it is delivered into the mold and as it solidifies, which results in a higher quality or more preferred castpart.

Embodiments of this trough assembly and configuration are particularly suited for application in large diameter castpart molds such as billet molds. Although the term circular and diameter are used herein in referring to the castparts and the aperture in the mold assembly, it will also be appreciated by those of ordinary skill in the art that this invention is not limited to circular cross section molds or the production of circular cross section castparts, but instead will apply to elliptical and other geometries and configurations of castparts, all within the contemplation of this invention.

Figure 3:
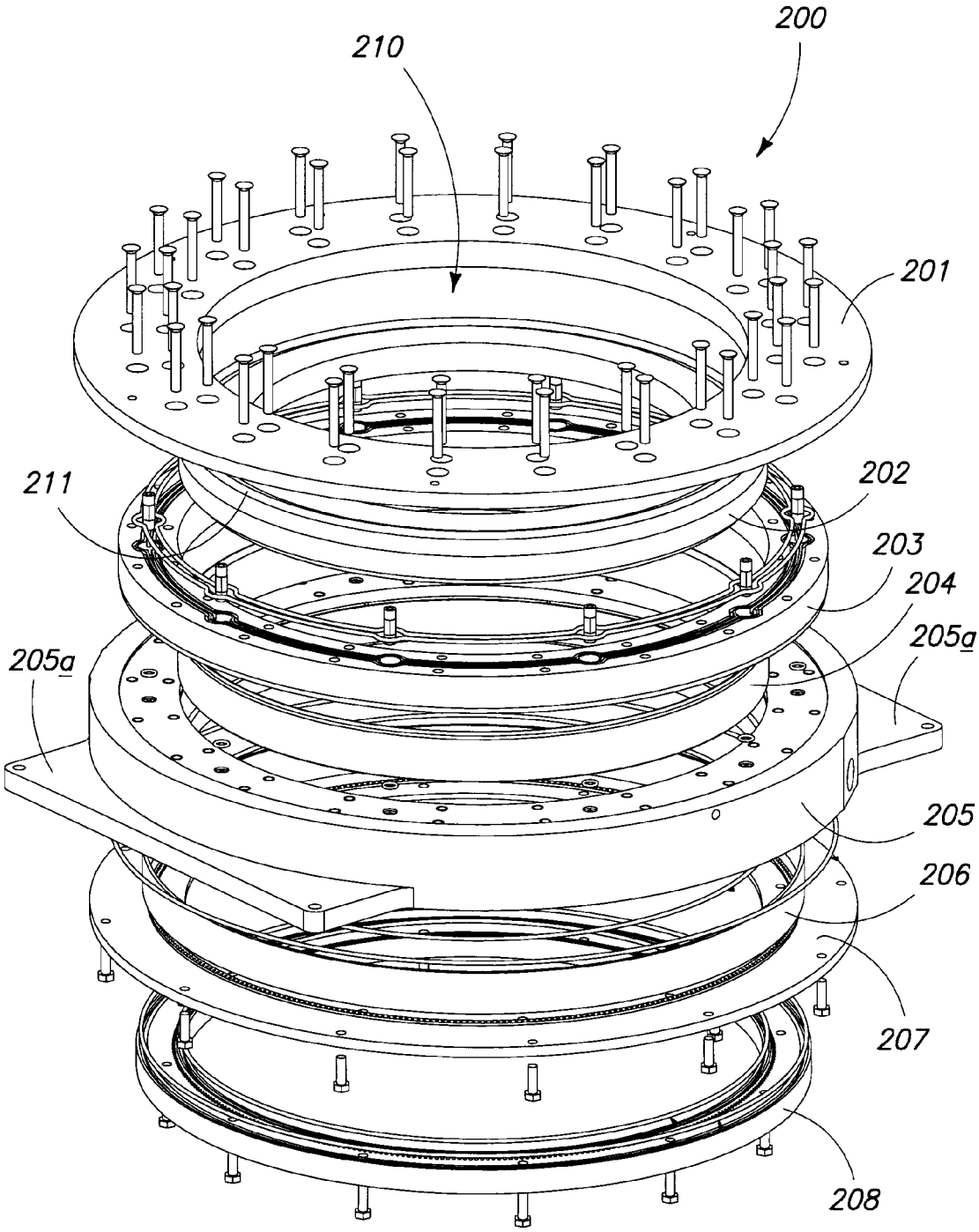
FIG. 3 is an exploded perspective elevation view of one example of a mold assembly which may be utilized in embodiments of this invention.

FIG. 3 is an exploded perspective view of one example of a mold assembly which may be utilized in embodiments of this invention. FIG. 3 and later figures for example illustrate a self centering transition plate configuration which provides a mold expansion management mechanism. FIG. 3 illustrates a molten metal mold system 200 including retaining ring 201, transition plate 202, casting ring 204, mold body 205 with mold body adapters 205*a* for securing the mold body to other components, mold body dam 206, spacer plate 207 and water jet ring 208.

Molten metal would be received from a molten metal distribution apparatus such as the trough system illustrated in FIG. 2 through mold aperture 210 and during the cooling process would be solidified as it emerged through the bottom portion or lower portion of the mold assembly illustrated in FIG. 3. During startup a starting block or head is positioned in the mold cavity to provide the bottom surface on which the castpart will solidify. As the molten metal fills the mold cavity and solidifies, the starting block is lowered and the solidified or partially solidified castpart emerges from the bottom of the mold cavity. The process continues until the desired castpart length is achieved.

An aspect or embodiment of this invention provides or imparts a biasing force on certain components of the mold assembly to maintain the self centering feature of the transition plate 202. In this example of this embodiment, O-rings (such as item 233 in FIG. 5) are utilized between the transition plate 202 and the retaining ring 201 to impart the biasing or centering force on the transition plate 202 against the casting ring 204. It is desired to maintain the positioning or centering of the transition plate 202 relative to the casting ring 204 to avoid any protrusions or non-smooth areas where the molten metal may cause the component to wear or deteriorate much quicker than it otherwise would. The biasing force (illustrated by item 237 in FIG. 5) on the transition plate 202 provides a self centering affect or feature and may provide a floating or non-fixed transition plate 202 during the expansion and contraction resulting from the addition and removal of heat.

Although the example of the embodiment illustrated in FIG. 3 shows a specific combination and assembly method and certain fasteners and connectors, it will be appreciated by those of ordinary skill in the art that any one of a number of different ways of assembling or fastening the components together as described may be utilized in still practicing this invention.

Figure 4:
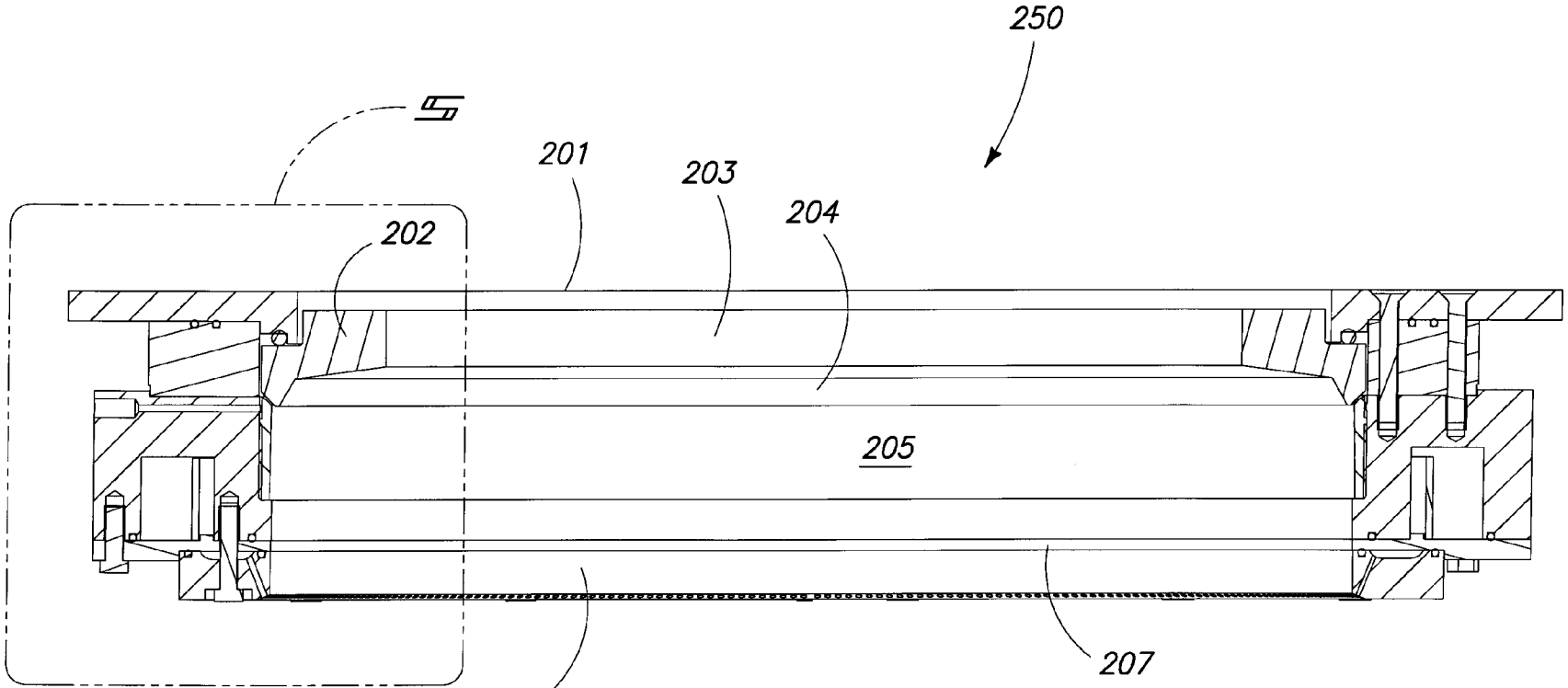
FIG. 4 is an elevation cross-sectional view of the exemplary mold configuration illustrated in FIG. 3 assembled.

FIG. 4 is an elevation cross-sectional view of the exemplary mold configuration or mold assembly 250 configuration as also illustrated in FIG. 3. FIG. 4 illustrates a mold assembly 250 which is the assembled version of that illustrated in exploded view in FIG. 3. FIG. 4 illustrates an example of a mold assembly 250 that may be utilized in embodiments of this invention, illustrating retaining ring 201, casting ring 204, mold body 205, transition plate 202, spacer plate 207 and water jet ring 208. The components illustrated in detail 5 are shown and more fully described in FIG. 5 below.

Figure 5:
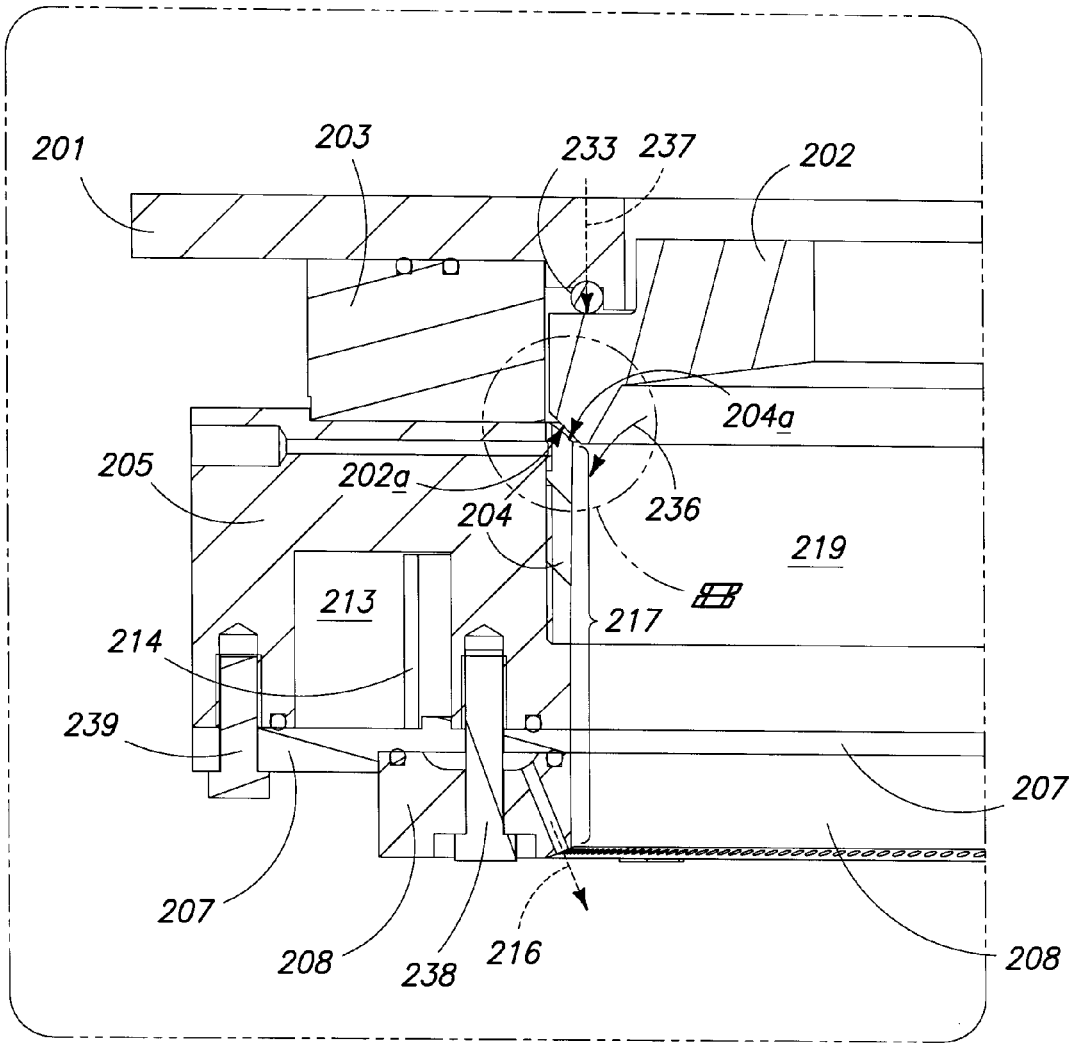
FIG. 5 is a detail 5 from FIG. 4.

FIG. 5 is a detail 5 from FIG. 4. FIG. 5 is a cross-sectional detail view from FIG. 4 and illustrates retaining ring 201, casting ring 204, transition plate 202, mold cavity 219, mold body 205, spacer plate 207, water jet ring 208, water conduit 213 with water dam 214, impinging water 216 emerging from water jet ring 208 to provide water cooling to a castpart moving through the mold.

FIG. 5 further illustrates how o-ring 233 is positioned under pressure between the retaining ring 201 and the transition plate 202, which in turn imparts a downward pressure from the angled surface 202*a* of the transition plate 202, on the angled surface 204*a* on the casting ring 204 as shown by the angle between the two. While the angled surface 204*a* on the casting ring is angled, a radius may also be utilized to achieve a better centering surface to interact with the angled surface 202*a* of the transition plate. When the retaining ring 201 is tightened down and the mold is assembled, it places a pressure between the angled surface 202*a* of transition plate 202 and the angled surface 204*a* of casting ring 204.

In embodiments of this invention, the assembly of the transition plate 202 relative to the casting ring 204, especially on a large diameter billet mold, needs to be relatively precise to provide the necessary fit. However, this precision is affected by the thermal expansion and contraction that occurs with the introduction of hot molten metal and then the removal of said metal. This expansion system also has a self-centering feature in that when the transition plate 202 is installed it self-centers itself due to the interaction of the angled surface 202*a* on the transition plate 202 combined with the angled surface 204*a* on the casting ring 204 to properly place it. Then when the retaining ring 201 is secured down with o-ring 233 between it and the transition plate 202, it gives a relatively precise and centered assembly of the transition plate 202 relative to the casting ring 204 and the use of the o-ring 233 places this under pressure, or pre-biases the relationship to allow for the continued desirable location of the transition plate 202 relative to the casting ring 204, including during thermal expansion and contraction.

It will be appreciated by those of ordinary skill in the art that while an o-ring 233 is utilized in this example of the embodiment, other mechanisms can be utilized to bias the transition plate 202 downwardly on the casting ring, such as a leaf spring or others, with no one in particular being required to practice this invention.

FIG. 5 also illustrates what is referred to in the industry as the bore length 217 of a given mold. The bore length is generally defined or identified from the transition where metal encounters the casting ring 204 in this type of application to where water impingement is occurring as indicated at the lower point of the bracket 217 representing the bore length. The coolant or water 216 emerging from water jet ring 208 provides the second point of reference to measure the bore length 217, i.e. where the water impingement occurs.

Figure 6:
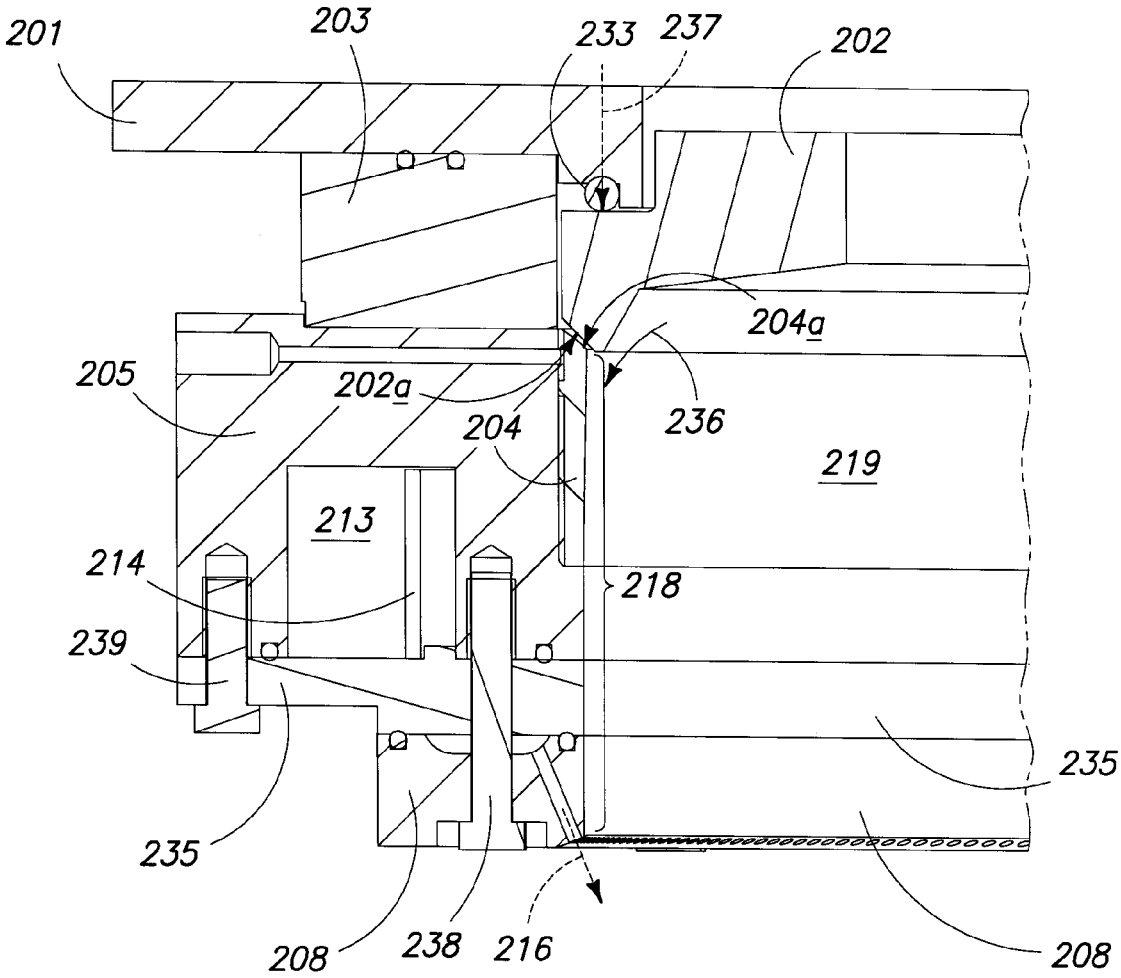
FIG. 6 is the same detail 5 from FIG. 4 as shown in FIG. 5 only wherein the thickness of the spacer plate is different than shown in FIG. 5, thereby illustrating the same mold with a different bore length.

In different casting speeds it is desirable to have a different bore length for particular casts. In many cases a different mold must be used to utilize a different bore length and the different mold would provide the preconfigured and predefined bore length (which cannot be adjusted with the existing components). Aspects of this invention, however, provide for a plurality of spacer plates 207 to be used, each of differing thicknesses so that the spacer plate 207 can be replaced with a thicker spacer plate and the bore length thereby affected without having to change the entire mold for a given desired application. This is a bore length adjustment system. FIG. 6 as described below shows a spacer plate 235 of a different thickness than spacer plate 207 (as shown in FIG. 5) as inserted in the same mold assembly. The differently sized spacer plate thereby provides bore length 218 which is different or dissimilar than bore length 217 as shown in FIG. 5. All other item numbers in FIG. 6 are like item numbers from FIG. 5 and will therefore not be repeated here.

FIG. 5 also shows arrow 236 which represents metal flow across the transition plate 202 to the casting ring 204 and which provides conduits through which oil is distributed to the casting ring and provided through the casting ring to the mold cavity 219 during the casting process. Arrow 236 shows the flow of molten metal toward the casting ring 204. Water jet ring bolt 238 and spacer plate bolt 239 is shown securing the mold assembly components together.

FIG. 6 is a detail 6 from FIG. 4. FIG. 6 is a cross-sectional detail view from FIG. 4 and illustrates retaining ring 201, casting ring 204, transition plate 202, mold cavity 219, mold body 205, spacer plate 235, water jet ring 208, water conduit 213 with water dam 214, impinging water 216 emerging from water jet ring 208 to provide water cooling to a castpart moving through the mold.

FIG. 6 further illustrates how o-ring 233 is positioned under pressure between the retaining ring 201 and transition plate 202, and the transition plate 202 thereby transmits the biasing force from the o-ring to the casting ring 204, as shown by the angle between the two. When the retaining ring 201 is tightened down and the mold is assembled, it places a pressure between the angled surface 202*a* of transition plate 202 and the angled surface 204*a* of casting ring 204.

In embodiments of this invention, the assembly of the transition plate 202 relative to the casting ring 204, especially on a large diameter billet mold, needs to be relatively precise to provide the necessary fit. However, this precision is affected by the thermal expansion and contraction that occurs with the introduction of hot molten metal and then the removal of said metal. This expansion system also has a self-centering feature in that when the transition plate 202 is installed it self-centers itself due to the interaction of the angled surface 202*a* on the transition plate 202 combined with the angled surface 204*a* on the casting ring 204 to properly place it. Then when the retaining ring 201 is secured down with O-ring 233 between it and the transition plate 202, it gives a relatively precise and centered assembly of the transition plate 202 relative to the casting ring 204. The use of the O-ring 233 places this under pressure, or pre-biases the relationship to allow for the continued desirable location of the transition plate 202 relative to the casting ring 204 all the while providing for thermal expansion and contraction.

It will be appreciated by those of ordinary skill in the art that while an O-ring 233 is utilized in this example of the embodiment, other mechanisms can be utilized to bias the transition plate downwardly on the oil distribution ring, such as a leaf spring or others, with no one in particular being required to practice this invention.

FIG. 6 also illustrates what is referred to in the industry as the bore length 218 of a given mold. The bore length is generally from the transition where metal encounters the casting ring 204 in this type of application to where water impingement is occurring as indicated at the point at the lower end of the bracket 218 (representing the bore length). The water 216 emerging from water jet ring 208 provides the second point of reference.

In different casting speeds it is desirable to have a different bore length for particular casts. In many cases a different mold must be used which has a preconfigured and predefined bore length which cannot generally be adjusted. Aspects of this invention, however, provide for a plurality of spacer plates to be used (such as items 207 and 235), each of differing thicknesses so that one spacer plate such as spacer plate 207 can be replaced with a thicker spacer plate such as spacer plate 235, which thereby changes the bore length without having to change the entire mold for a given desired application. FIG. 6 as described below shows a spacer plate 235 of a different thickness than spacer plate 207 is inserted in the same mold and thereby provides bore length 218 which is different or dissimilar than bore length 217 as shown in FIG. 5. All other item numbers in FIG. 6 are like item numbers from FIG. 5 and will therefore not be repeated here.

The changing of the bore length in a given embodiment of this invention may also be accomplished in one or more of a number of different ways, including: providing a mold assembly with no spacer plate and then adding one or more spacer plates to change the bore length of the mold; or providing a plurality of spacer plates of equal thickness which can be utilized to achieve different bore lengths with the same mold (either by starting with no spacer plates and adding one or more, or by starting with one or more and then adding or removing spacer plates as desired); all within the contemplation of different embodiments of this invention.

FIG. 6 also shows arrow 236 which represents the flow of molten metal across the transition plate 202 to the casting ring 204 and which provides conduits through which oil is distributed to the casting ring and provided through the casting ring to the mold cavity 219 during the casting process. Arrow 236 shows the flow of molten metal toward the casting ring 204.

Figure 7:
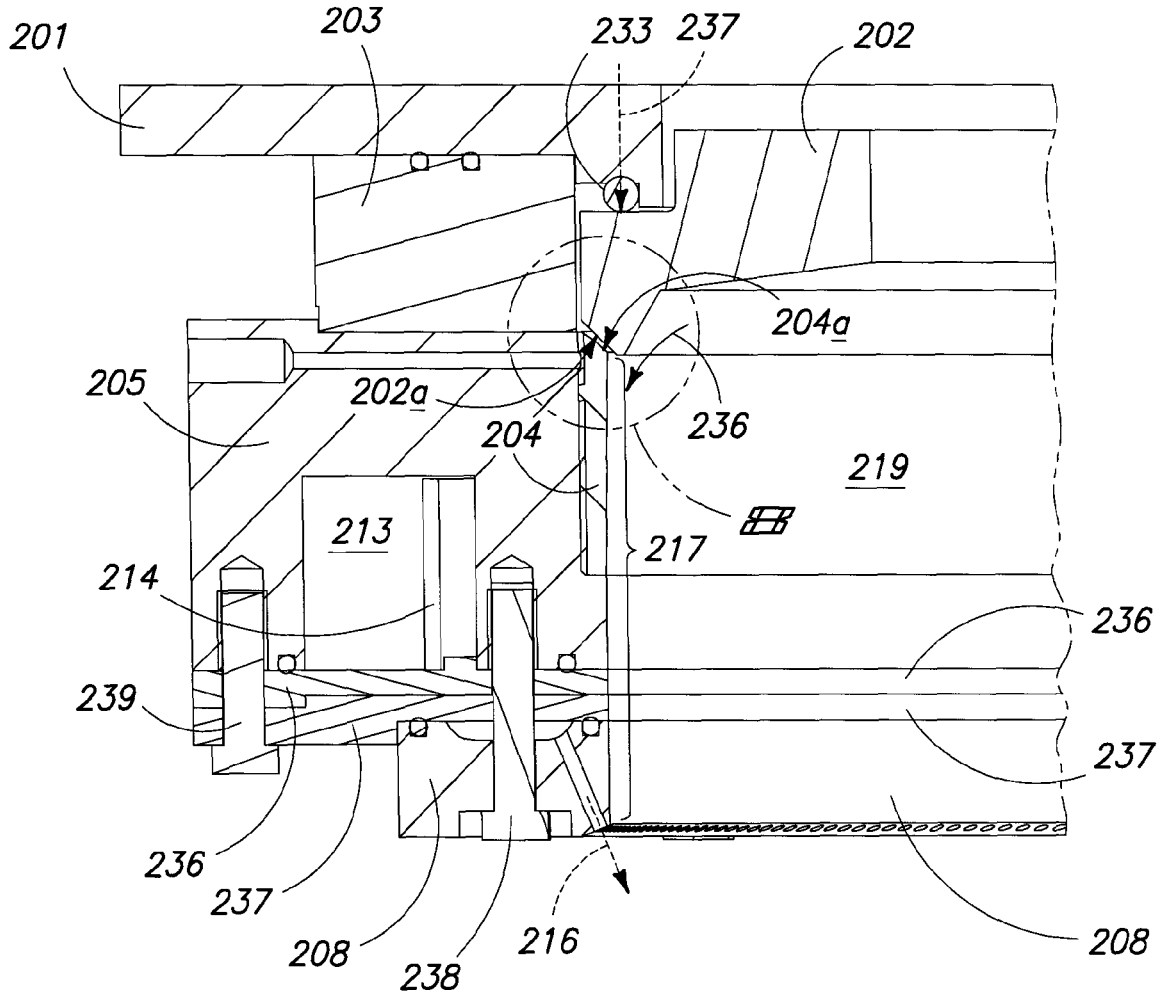
FIG. 7 is the same detail 5 from FIG. 4 as shown in FIG. 5 only wherein there are two spacer plates of equal thickness, thereby illustrating the same mold with a different bore length.

FIG. 7 is the same detail 5 from FIG. 4 as shown in FIG. 5 only wherein there are two spacer plates of equal thickness, thereby illustrating the same mold with a different bore length. The item numbers in FIG. 7 are the same as the like item numbers in FIG. 6, with the addition of first spacer plate 236 and second spacer plate 237, which are shown the same thickness, but which may also be dissimilar thicknesses.

Figure 8:
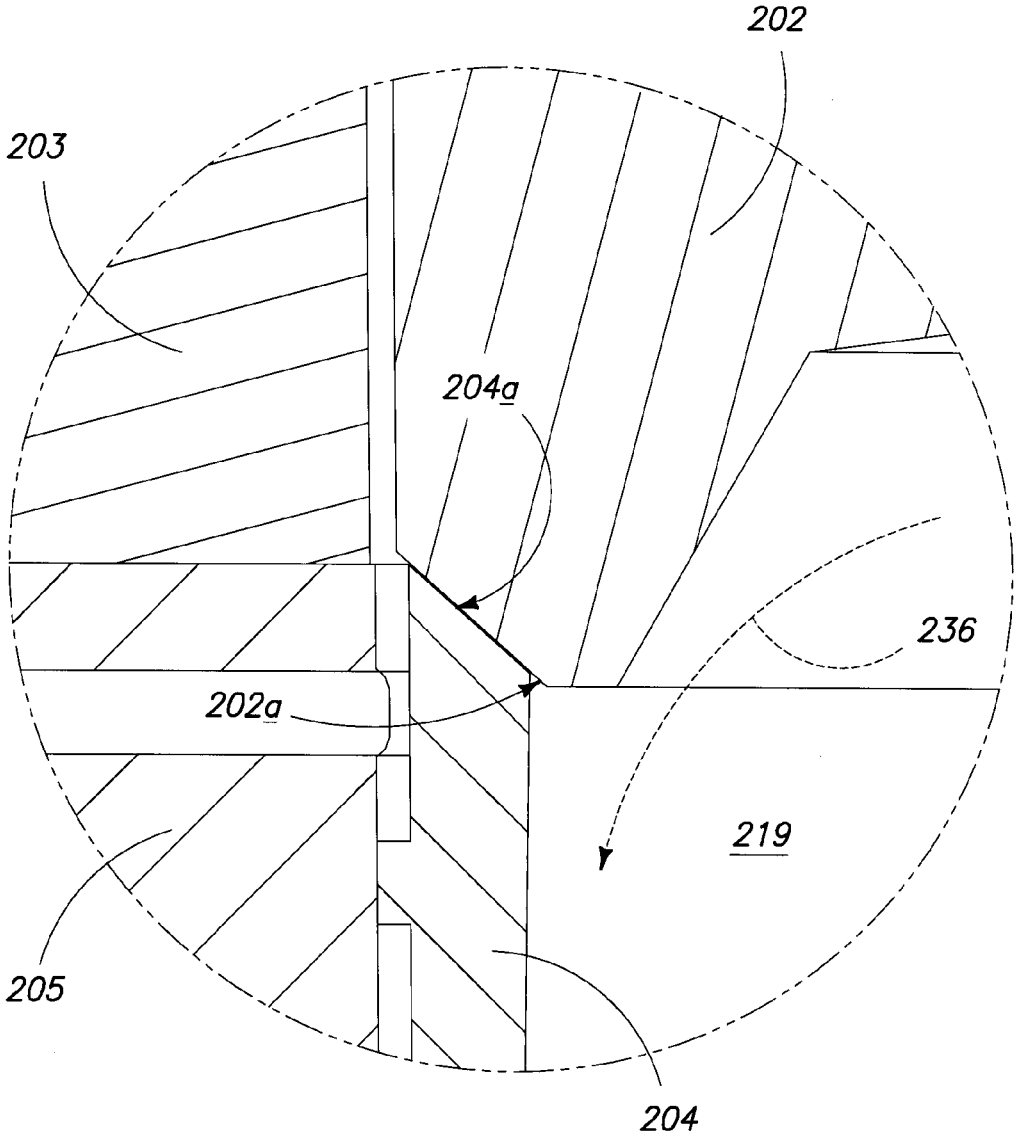
FIG. 8 is detail 8 from FIG. 5.

FIG. 8 is a detailed cross-sectional view 8 from FIG. 5, and illustrates metal flow 236 and mold cavity 219 going from transition plate 202 to casting ring 204. It will be appreciated by those of ordinary skill in the art that oil is permeated through casting ring 204 providing lubrication at the internal surface of casting ring 204 which contacts the molten metal 236 flowing downwardly.

FIG. 8 illustrates the interface between the transition plate 202 and the casting ring 204 via the angled surface 202*a* of the transition plate 202 and the angled surface 204*a* of the casting ring 204, which in this example of an embodiment are both shown approximately or relatively flat.

Figure 9:
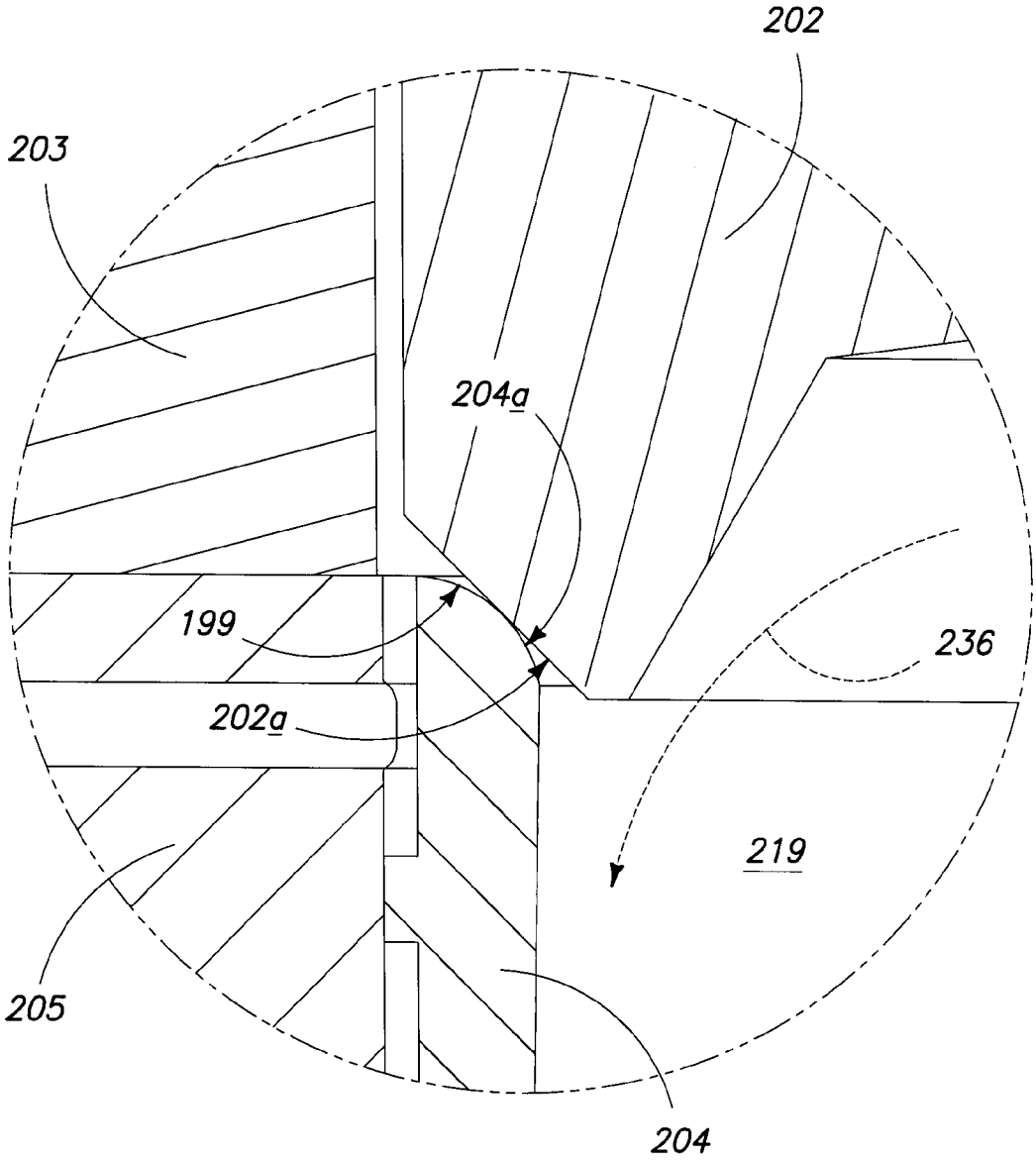
FIG. 9 is also detail 8 from FIG. 5, only wherein a radius is shown on the angled surface of the casting ring.

FIG. 9 is also detail 8 from FIG. 5, only wherein a radius 199 is shown on the angled surface 204*a* of the casting ring 204. It will be appreciated by those of ordinary skill that both the angled surface 204*a* of the casting ring 204 and the angled surface 202*a* of the transition plate 202 may both include a radius (as shown in FIG. 11), or both may be a flat angled surface (as shown in FIG. 8), or also that the angled surface 202*a* of the transition plate 202 may include a radius (shown in FIG. 10) such as that shown as item 198 combined with the angled surface 204*a* of the casting ring 204 being approximately flat in contour. It is to be understood that the radius 199 in FIG. 9 and radius 198 in FIG. 10, may be any one of a number of different values depending on the application or the embodiment, with no one in particular being required to practice this invention. The amount of the radius shown is exaggerated for illustrative purposes, with the desired radius for any specific application varying based on several factors (such as mold diameter, casting ring configurations and transition plate configurations). All other like numbered items are the same as for FIG. 8 and will not be repeated here.

Figure 10:
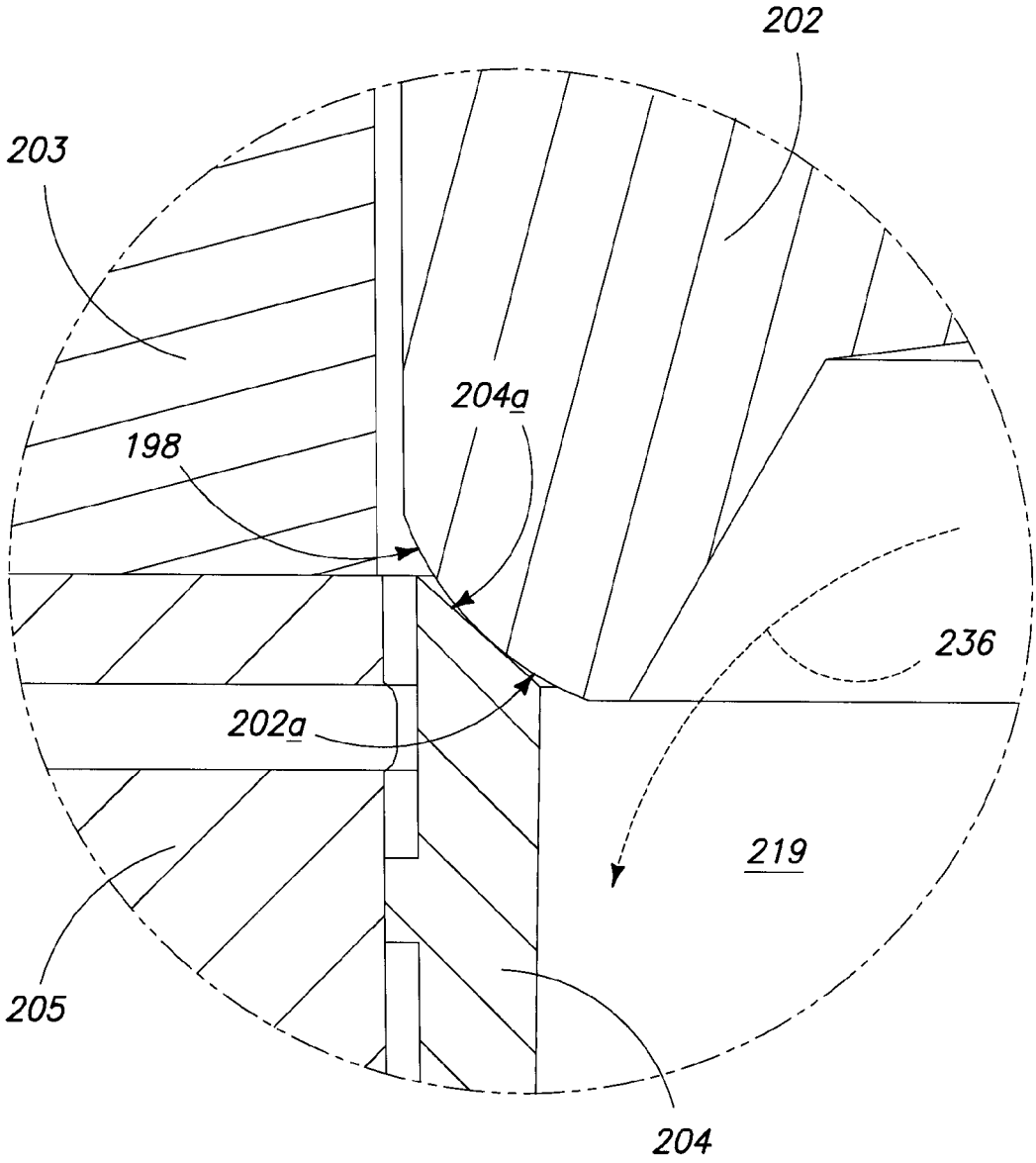
FIG. 10 is also detail 8 from FIG. 5, only wherein a radius is shown on the angled surface of the transition plate.
Figure 11:
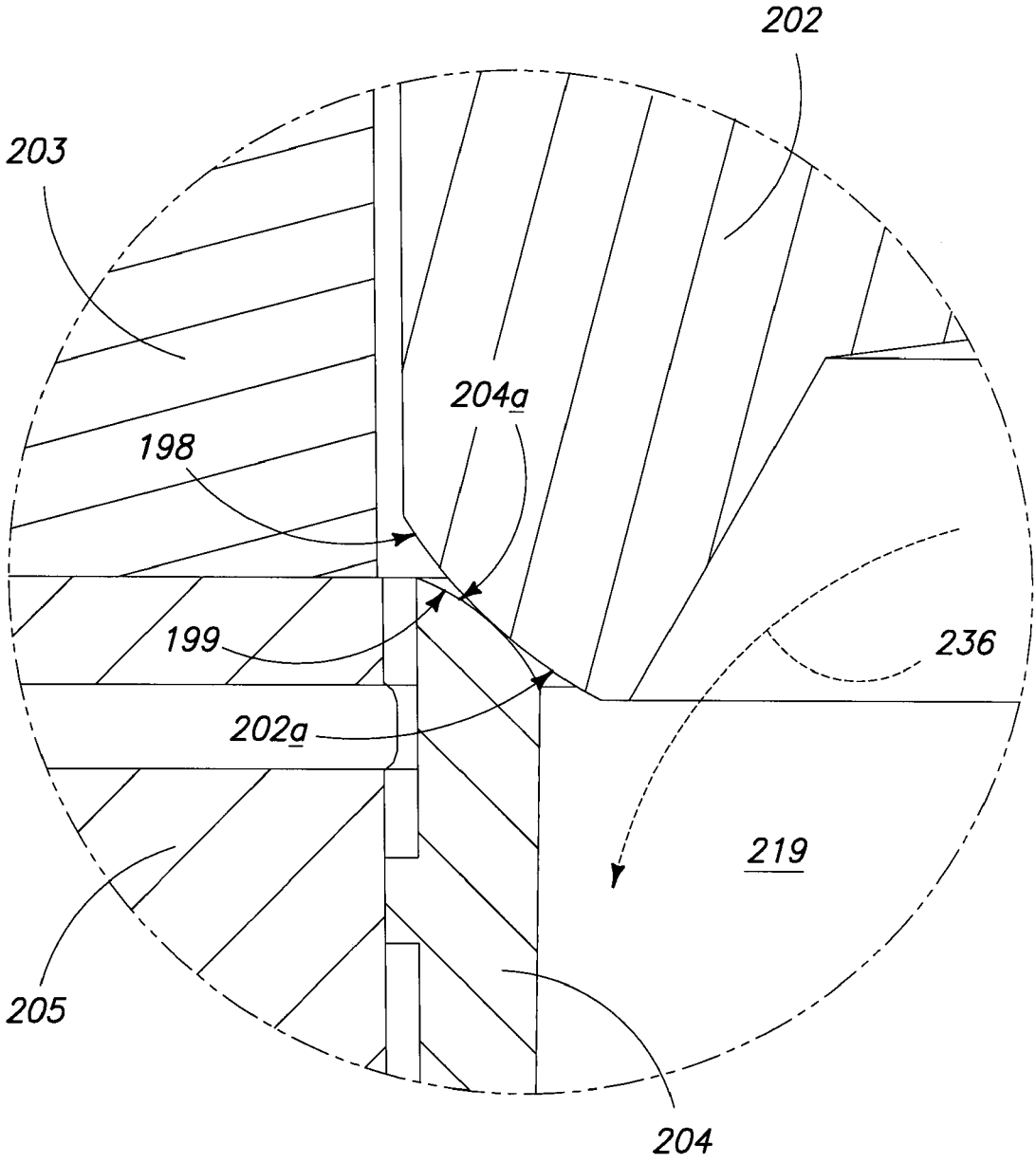
FIG. 11 is also detail 8 from FIG. 5, only wherein a radius is shown both on the angled surface of the casting ring and on the angled surface of the transition plate.
Figure 11:
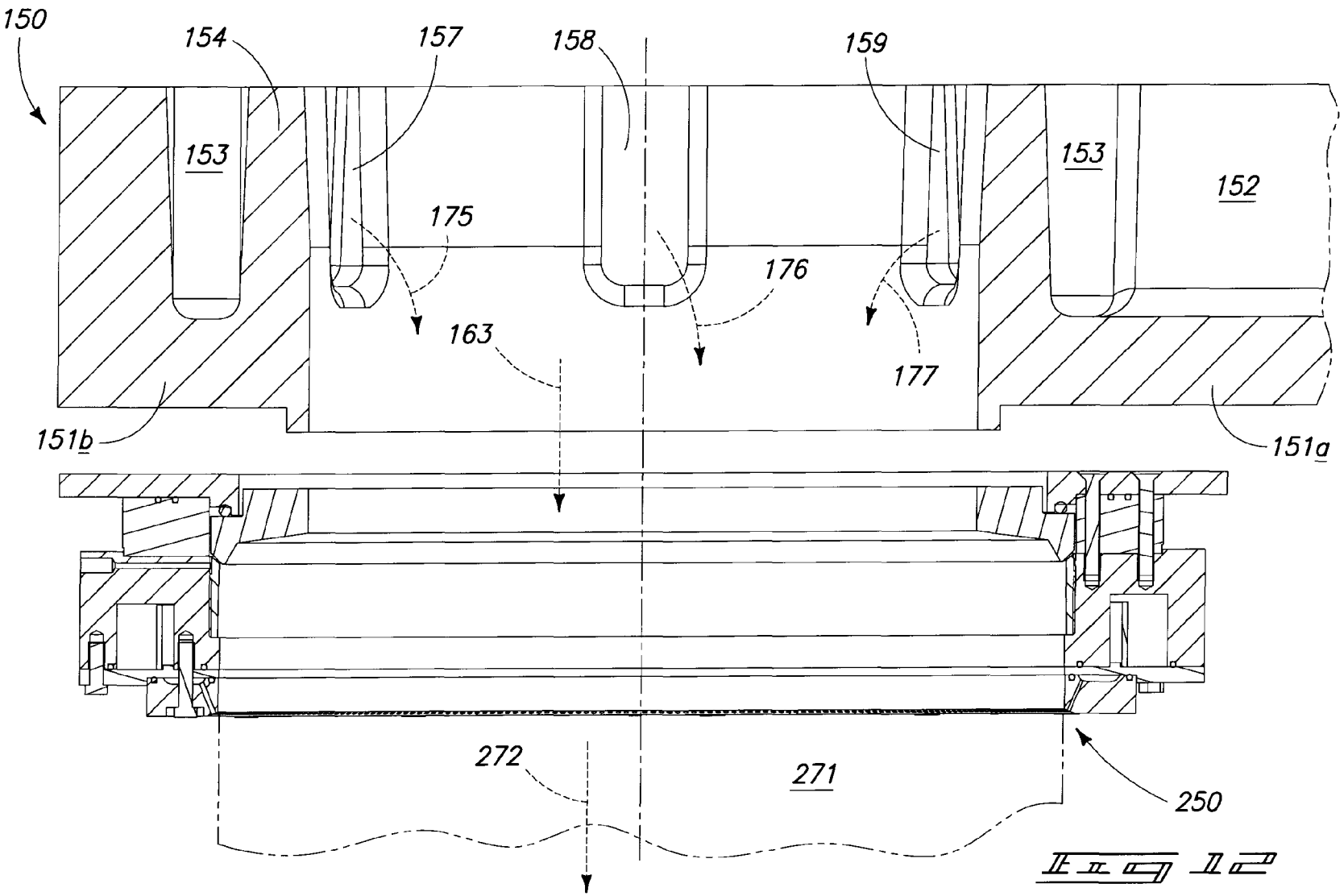

FIG. 10 is also detail 8 from FIG. 5, only wherein a radius 198 is shown on the angled surface 202*a* of the transition plate 202. All other like numbered items are the same as for FIG. 8 and will not be repeated here.

FIG. 11 is also detail 8 from FIG. 5, only wherein a radius 199 is shown on the angled surface of the casting ring 204 and a radius 198 is also shown on the angled surface 202*a* of the transition plate 202. All other like numbered items are the same as for FIG. 8 and will not be repeated here.

FIG. 12 is an elevation view of one example of a trough assembly vertically over a mold assembly which may be utilized in embodiments of this invention. FIG. 12 illustrates molten metal trough system 150 such as shown and more fully described in FIG. 2 vertically above mold assembly 250 as described more fully above beginning in FIG. 4, along with the flow of molten metal as represented by arrow 163 between molten metal trough system 150 and mold assembly 250. Castpart 271 is seen emerging below mold assembly 250 and arrow 272 indicates that the castpart is gradually being lowered as the molten metal provided to the mold solidifies, thereby creating a castpart 271 which may also be referred to as a billet.

FIG. 12 illustrates trough body 151 with trough body inlet portion 151*a* and trough main body portion 151*b*. Trough gates or apertures 157, 158 and 159 are illustrated in FIG. 12 with molten metal flow indicated through the respective gates 157, 158 and 159 by arrows 175, 176 and 177 respectively. Internal trough 153 is shown within the trough body 151*b* and trough wall 154 is shown between internal trough 153 and the aperture 160 in the molten metal trough system 150 (shown in other figures). Inlet trough 152 is shown in trough body inlet portion 151*a*.

It will be appreciated by those of ordinary skill in the art the benefits or potential advantages of having an easily modifiable bore length in a system of interchangeable spacer plates to accomplish that for a given mold. This for instance may provide the benefit of requiring fewer molds in a casting house or by optimizing the bore length, the quality of the resulting castparts will be improved more easily and cost efficient.

While there may be variations in how some in the industry define bore length, it is generally defined as the distance between the point where the molten metal contacts the casting surface to the lower lip where there is water impingement on the castpart. That distance generally has different ramifications in the molding process and resulting castpart and in some embodiments, the water impingement distance determines how far upward toward the casting ring the solidification of the molten metal occurs. It is normally a goal of the casting process to optimize that bore length for a given casting speed and mold assembly. This allows the sale of one mold assembly system with multiple spacer plates to provide flexibility and optimization capability to the customer.

In embodiments of the mold expansion system, the transition plate or "T-plate" as it is sometimes called in the industry, becomes floating in that it is not locked into one position because it has an angled surface that interacts with an opposing angled surface on the casting ring and it is tensioned down or pre-biased by the spring above the T-plate (which in the embodiment shown in this disclosure is an O-ring). In a circular castpart configuration where the transition plate is generally circular and the casting ring is generally circular, the combination of the downward biasing and the opposing angled surfaces provides a self-centering feature or advantage. The failure to have a well centered transition plate leaves or may leave an exposed portion of the transition plate that would degrade faster than if it were better centered and a degrading transition plate would affect the surface quality on the resulting castpart or billet. This expansion system not only provides a better self-centering mechanism but also because the transition plate is under constant biasing or force from the O-ring, it provides such a centering which can be generally maintained during the expansion and contraction of the mold assembly from the heat introduced by the molten metal. Aspects of this invention may help reduce or avoid the degradation that would occur in prior art systems. Again, it will be appreciated by those of ordinary skill in the art that other mechanisms for imposing a biasing force such as a spring or a leaf spring may be utilized instead of an O-ring, with no one in particular being required to practice this invention.

While the aspects and embodiments of this invention have good application in large diameter molds, this invention or different aspects of this invention are not so limited. When the term large diameter mold is used it is generally referring to molds of 20 or 21 inches or greater in diameter.

As will be appreciated by those of reasonable skill in the art, there are numerous embodiments to this invention, and variations of elements and components which may be used, all within the scope of this invention.

In one embodiment for example, a continuous cast molten metal delivery system for casting billet shaped castparts, comprising: a molten metal distribution trough body comprised of an outer trough containment wall and an inner trough wall concentrically within the outer trough containment wall; the inner trough wall surrounding and defining a billet shaped molten metal delivery aperture and including a plurality of molten metal gates around the inner trough wall and configured to provide a flow conduit from the internal trough to the delivery aperture; and a trough inlet operatively connected to the inner trough and disposed to receive molten metal and provide it to the internal trough in the trough body.

In another embodiment of the invention, a continuous cast molten metal mold assembly is provided, which includes a force-biased self-centering transition plate system, comprising: a casting ring with an upper angled surface angled inwardly toward the center of the casting ring; a transition plate with a lower angled surface angled radially outwardly, and configured to interface with the upper angled surface of the casting ring; a biasing force imparted downwardly on the transition plate; and wherein the interaction of the upper angled surface of the casting ring with the lower angled surface of the transition plate, combined with the biasing force, provide a self-centering transition plate relative to the casting ring. In this embodiment, the transition plate may be provided to interface with the casting ring in a non-fixed manner or floating manner with the casting ring.

In another embodiment of the invention, a continuous cast molten metal mold system which has a given bore length is provided, and which comprises: a mold assembly with a bore length, said mold assembly including at least one spacer plate, wherein one or more of the at least one spacer plates are mounted between a transition point and an area of impingement, thereby altering the bore length of the mold. This provides a variable bore length mold system.

In yet another embodiment of the invention, a continuous cast molten metal system for casting billet shaped castparts is provided which comprises: a molten metal distribution trough body comprised of an outer trough containment wall and an inner trough wall concentrically within the outer trough containment wall, the inner trough wall surrounding and defining a billet shaped molten metal delivery aperture and including a plurality of molten metal gates around the inner trough wall and configured to provide a flow conduit from the internal trough to the delivery aperture, and a trough inlet operatively connected to the inner trough and disposed to receive molten metal and provide it to the internal trough in the trough body; a casting ring with a mold cavity disposed to receive molten metal from the molten metal delivery aperture of the molten metal distribution trough body, the casting ring including an upper angled surface angled inwardly toward the center of the casting ring; a transition plate with a lower angled surface angled radially outwardly, and configured to interface with the upper angled surface of the casting ring; a biasing force imparted downwardly on the transition plate; wherein the interaction of the upper angled surface of the casting ring with the lower angled surface of the transition plate, combined with the biasing force, provide a self-centering transition plate relative to the casting ring; further comprising a water jet ring configured to provide coolant impingement to the mold cavity; and wherein a distance between the transition plate and the water jet ring defines a mold bore length, and further wherein at least one spacer plate is mounted between the transition plate and the water jet ring, the at least one spacer plate thereby altering the bore length of the mold.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A continuous cast molten metal mold assembly providing a force-biased self-centering transition plate system, comprising:

a casting ring with an upper angled surface angled inwardly toward the center of the casting ring;

a transition plate with a lower angled surface angled radially outwardly, and configured to interface with the upper angled surface of the casting ring;

a retaining ring for providing a biasing force imparted downwardly on the transition plate; and wherein the interaction of the upper angled surface of the casting ring with the lower angled surface of the transition plate, combined with the biasing force, provide a self-centering transition plate relative to the casting ring.

2. The continuous cast molten metal mold assembly as recited in claim 1, and further wherein the transition plate interfaces in a non-fixed manner with the casting ring.

3. A continuous cast molten metal mold assembly providing a force-biased self-centering transition plate system as recited in claim 1, and further wherein the retaining ring indirectly provides the biasing force imparted downwardly on the transition plate.

4. A continuous cast molten metal mold assembly providing a force-biased self-centering transition plate system as recited in claim 3, and further wherein one of an O-ring and a spring is provided between the retaining ring and the transition plate to provide the biasing force imparted downwardly on the transition plate.

5. A continuous cast molten metal mold assembly providing a force-biased self-centering transition plate system as recited in claim 1, and further wherein the mold assembly has a bore length, said mold assembly including at least one spacer plate, wherein one or more of the at least one spacer plates are mounted between a transition point where molten metal encountering the casting ring and an area of coolant impingement, thereby altering the bore length of the mold.

6. A continuous cast molten metal system for casting billet shaped castparts, comprising:

a molten metal distribution trough body comprised of an outer trough containment wall and an inner trough wall concentrically within the outer trough containment wall, the inner trough wall surrounding and defining a billet shaped molten metal delivery aperture and including a plurality of molten metal gates around the inner trough wall and configured to provide a flow conduit from the internal trough to the delivery aperture, and a trough inlet operatively connected to the inner trough and disposed to receive molten metal and provide it to the internal trough in the trough body;

a casting ring with a mold cavity disposed to receive molten metal from the molten metal delivery aperture of the molten metal distribution trough body, the casting ring including an upper angled surface angled inwardly toward the center of the casting ring;

a transition plate with a lower angled surface angled radially outwardly, and configured to interface with the upper angled surface of the casting ring;

a retaining ring for providing a biasing force imparted downwardly on the transition plate;

wherein the interaction of the upper angled surface of the casting ring with the lower angled surface of the transition plate, combined with the biasing force, provide a self-centering transition plate relative to the casting ring;

further comprising a water jet ring configured to provide coolant impingement to the mold cavity; and wherein a distance between the transition plate and the water jet ring defines a mold bore length, and further wherein at least one spacer plate is mounted between the transition plate and the water jet ring, the at least one spacer plate thereby altering the bore length of the mold.

7. A continuous cast molten metal system for casting billet shaped castparts as recited in claim 6, and further wherein the retaining ring indirectly provides the biasing force imparted downwardly on the transition plate.

8. A continuous cast molten metal system for casting billet shaped castparts as recited in claim 7, and further wherein one of an O-ring and a spring is provided between the retaining ring and the transition plate to provide the biasing force imparted downwardly on the transition plate.

* * * * *